US010151526B1

(12) United States Patent
Pathapati et al.

(10) Patent No.: US 10,151,526 B1
(45) Date of Patent: Dec. 11, 2018

(54) STORAGE ASSEMBLY FOR AN APPLIANCE

(71) Applicant: Haier US Appliance Solutions, Inc., Wilmington, DE (US)

(72) Inventors: Madan Gopal Reddy Pathapati, Louisville, KY (US); Bagawathkumar Chellappan, Louisville, KY (US); Louis A. Wantland, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/599,511

(22) Filed: May 19, 2017

(51) Int. Cl.

| | |
|---|---|
| ***F25D 25/00*** | (2006.01) |
| ***F25D 25/02*** | (2006.01) |
| ***F25D 23/06*** | (2006.01) |
| ***F25D 23/08*** | (2006.01) |
| ***F25D 23/10*** | (2006.01) |
| *A47B 88/40* | (2017.01) |
| *F25C 5/20* | (2018.01) |

(52) U.S. Cl.
CPC ..... *F25D 25/025* (2013.01); *F25D 23/06* (2013.01); *F25D 23/08* (2013.01); *F25D 23/10* (2013.01); *F25D 25/027* (2013.01); *A47B 88/40* (2017.01); *A47B 2210/175* (2013.01); *F25C 5/22* (2018.01); *F25D 2323/122* (2013.01)

(58) Field of Classification Search
CPC .... F25D 25/027; F25D 25/005; F25D 23/025; F25D 23/02; F25C 5/22; A47B 2210/175
USPC ..... 312/405, 326, 329, 408, 404, 405.1, 312/321.5; 108/21, 142
See application file for complete search history.

(56) References Cited

U.S. PATENT DOCUMENTS

| | | | | |
|---|---|---|---|---|
| 719,625 | A * | 2/1903 | Throm | |
| 2,558,602 | A * | 6/1951 | Atchison | F25D 23/025 220/263 |
| 2,692,813 | A * | 10/1954 | Toronto | F25D 25/027 312/329 |
| 2,877,077 | A * | 3/1959 | Robinson | F25D 23/04 16/378 |
| 2,955,892 | A * | 10/1960 | Pulaski | A47B 49/004 211/150 |
| 2,963,171 | A * | 12/1960 | Johnson | F25D 25/027 108/139 |
| 3,063,775 | A * | 11/1962 | Snowman | F25D 25/027 108/141 |
| 3,096,885 | A * | 7/1963 | Peters | F25D 25/027 248/240 |
| 3,167,186 | A * | 1/1965 | Squire | F25D 25/027 108/141 |

(Continued)

FOREIGN PATENT DOCUMENTS

| | | |
|---|---|---|
| CN | 204115386 U | 1/2015 |
| JP | 2012207855 A | 10/2012 |

(Continued)

*Primary Examiner* — Janet M Wilkens
(74) *Attorney, Agent, or Firm* — Dority & Manning, P.A.

(57) ABSTRACT

A storage assembly for an appliance, such as a refrigerator appliance, is generally provided herein. The storage assembly may include a bracket attached to the appliance and a storage bin rotatably mounted to the bracket. The storage bin may rotate about a rotation axis, such as between a home position and a distal position angularly spaced apart from the home position when mounted to the bracket.

22 Claims, 13 Drawing Sheets

(56) References Cited

U.S. PATENT DOCUMENTS

| | | | | |
|---|---|---|---|---|
| 3,172,715 | A * | 3/1965 | Powder | F25D 25/027 108/106 |
| 4,448,464 | A * | 5/1984 | Reichert | F25D 25/027 312/322 |
| 5,685,624 | A | 11/1997 | Lee | |
| 7,469,980 | B2 | 12/2008 | Koo | |
| 9,103,581 | B2 | 8/2015 | Babinski et al. | |
| 2006/0132007 | A1* | 6/2006 | Beckley | B60R 7/04 312/325 |
| 2017/0276424 | A1* | 9/2017 | Wantland | F25D 25/005 |

FOREIGN PATENT DOCUMENTS

| | | | |
|---|---|---|---|
| WO | WO2011080192 | A2 | 7/2011 |
| WO | WO2012062883 | A2 | 5/2012 |

* cited by examiner

STORAGE ASSEMBLY FOR AN APPLIANCE

FIELD OF THE INVENTION

The present subject matter relates generally to storage assemblies within appliances, such as refrigerator appliances.

BACKGROUND

Refrigerator appliances generally include a cabinet that defines a chilled chamber for receipt of food articles for storage. The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

A design goal for refrigerator appliances can include providing flexibility in arranging storage components within the appliance's chilled chamber. Such flexibility can improve consumer satisfaction with the appliance and allow various items to be more easily accessed. Consequently, the storage components of certain refrigerator appliances can be adjusted or repositioned within the chilled chamber depending upon the configuration desired or selected by a user. However, repositioning storage components offers limited flexibility in arranging such storage components. Accessibility may even be decreased at certain positions. Moreover, it can be difficult to clean such components since they must either be cleaned within the refrigerator appliance, or removed in their entirety. It is even possible that during removal and/or use, adjustable storage components may damage or mar other portions of the refrigerator appliance.

Accordingly, a refrigerator appliance with features for improving storage of food items within a chilled chamber of the appliance would be useful. In particular, a refrigerator appliance with features for facilitating access to items located at a back of a storage feature would be useful. It would also be advantageous to provide a refrigerator appliance with features for storage that could be readily disassembled for easy adjustments and/or cleaning. Still further, it would be advantageous to provide a refrigerator appliance with features for storage that could protect other components from damage.

BRIEF DESCRIPTION

Aspects and advantages of the invention will be set forth in part in the following description, or may be obvious from the description, or may be learned through practice of the invention.

In one aspect of the present disclosure, a storage assembly for a refrigerator appliance is provided. The storage assembly may include a bracket attached to the refrigerator appliance, a support base, a storage bin, and a mating pair. The support base may be rotatably mounted to the bracket along a rotation axis. The storage bin may be removably mated to the support base and positioned thereabove. The mating pair may be formed between the support base and the storage bin. The mating pair may include a post and pocket. The post may extend along a vertical direction from one of the support base and the storage bin. The pocket may be defined within the other of the support base and the storage bin to receive the post therein.

In another aspect of the present disclosure, a storage assembly for a refrigerator appliance is provided. The storage assembly may include a bracket attached to the refrigerator appliance, a storage bin, a positioning prong, and an elastic finger. The storage bin may be rotatably mounted to the bracket along a rotation axis between a home position and a distal position angularly spaced apart from the home position. The positioning prong may extend below the storage bin in a vertical direction. The positioning prong may be rotationally fixed relative to the storage bin. The elastic finger may extend from the bracket perpendicular to the axis of rotation. The elastic finger may define a ridge to selectively hold the positioning prong in the home position.

In yet another aspect of the present disclosure, a storage assembly for a refrigerator appliance is provided. The storage assembly may include a bracket attached to the refrigerator appliance, a storage bin, a positioning prong, and an elastic finger. The storage bin may be rotatably mounted to the bracket along a rotation axis between a home position and a distal position angularly spaced apart from the home position. The positioning prong may extend below the storage bin in a vertical direction. The positioning prong may be rotationally fixed relative to the storage bin. The elastic finger may extend from the bracket perpendicular to the axis of rotation. The elastic finger may be in biased engagement with the positioning prong to motivate the storage bin away from the home position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
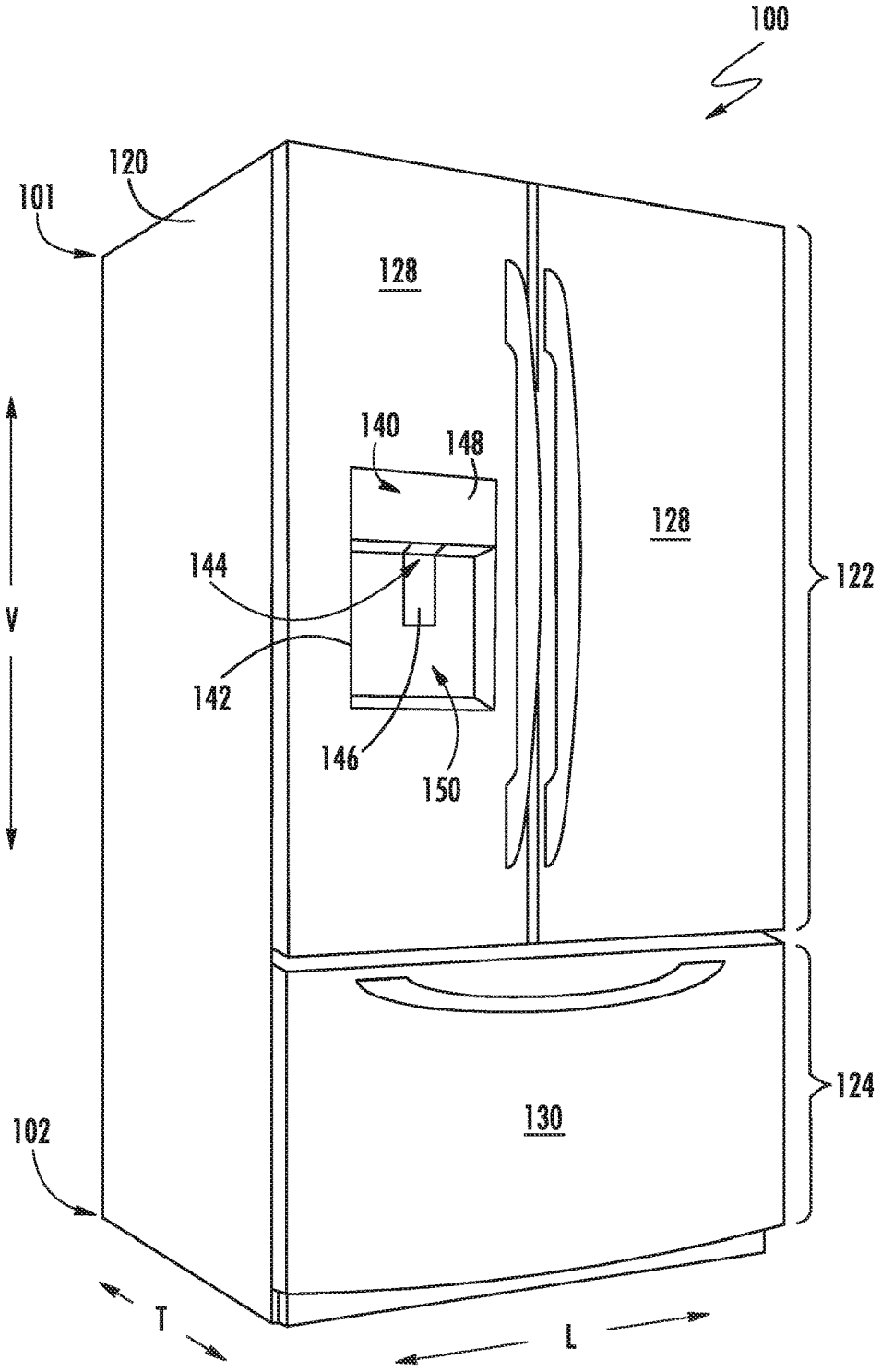
FIG. 1 provides a perspective view of a refrigerator appliance according to example embodiments of the present disclosure, wherein refrigerator doors are shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 provides a perspective view of a refrigerator appliance 100 according to example embodiments of the present subject matter. Refrigerator appliance 100 includes a cabinet or housing 120 that extends between a top 101 and a bottom 102 along a vertical direction V. Housing 120 also extends along a lateral direction L and a transverse direction T, each of the vertical direction V, lateral direction L, and transverse direction T being mutually perpendicular to one another. Housing 120 defines chilled chambers for receipt of food items for storage. In particular, housing 120 defines a fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

In some embodiments, refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative example embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128.

Figure 2:
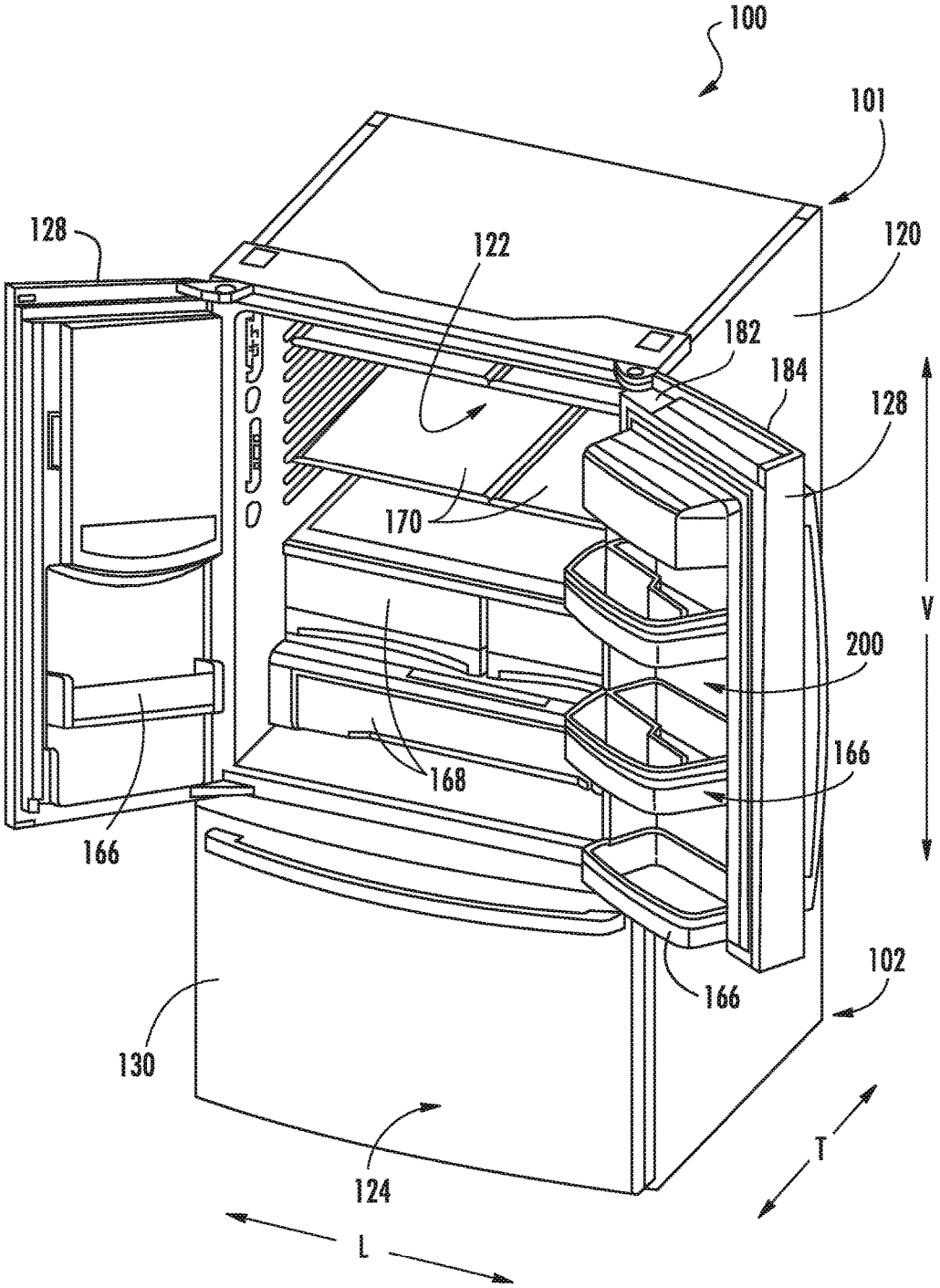
FIG. 2 provides a perspective view of the example refrigerator appliance of FIG. 1, wherein refrigerator doors are shown in an open position to reveal a fresh food chamber.

FIG. 2 provides a perspective view of a door of refrigerator appliance 100 shown with refrigerator doors 128 in the open position. According to the illustrated embodiment, various storage components are mounted within fresh food chamber 122 to facilitate storage of food items therein as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages and/or solid food items) and may assist with organizing such food items. As an example, drawers 168 can receive fresh food items (e.g., vegetables, fruits, and/or cheeses) and increase the useful life of such fresh food items.

As will be discussed below, refrigerator appliance 100 may include an adjustable storage assembly 200 located on refrigerator door 128. Storage assembly 200 can include one or more storage bins 166 that include a rotatable base for easily accessing items stored in storage bins 166.

Figure 3:
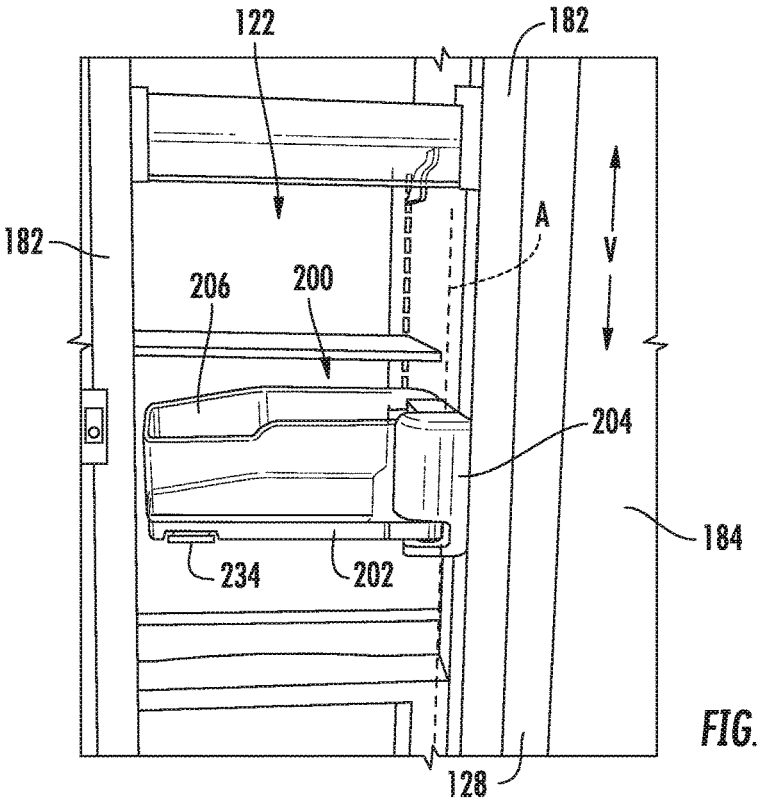
FIG. 3 provides a perspective view of a storage assembly within a refrigerator appliance according to example embodiments of the present disclosure, wherein a support base is shown at a home position.
Figure 4:
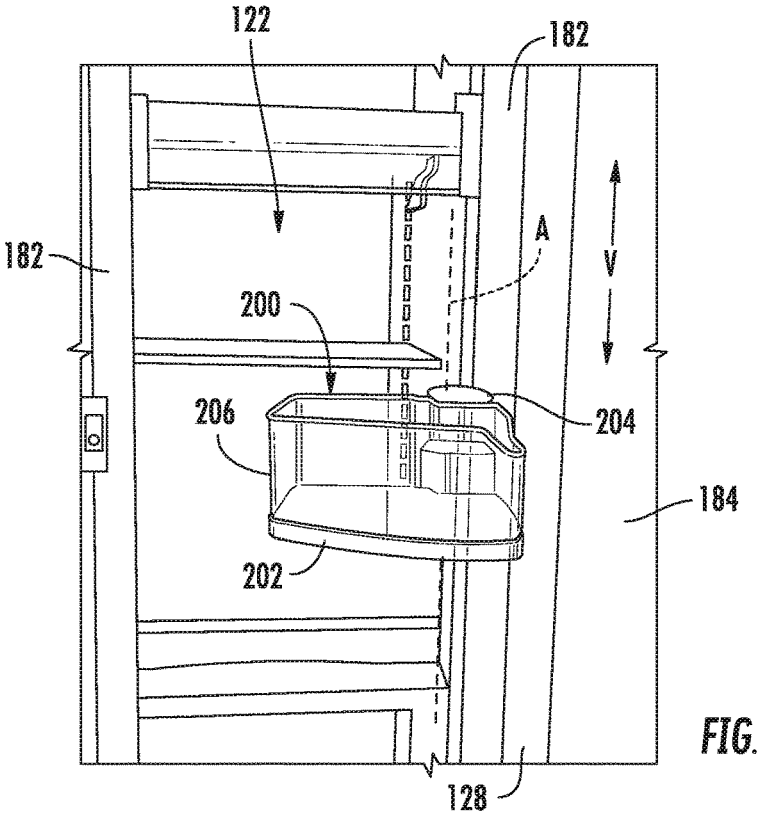
FIG. 4 provides a perspective view of the example storage assembly of FIG. 3, wherein the support base is shown at a distal position.

Referring now to FIGS. 3 and 4, storage assembly 200 generally includes a support base 202 that is rotatably mounted to a portion of refrigerator appliance 100. For instance, support base 202 may be rotatably mounted to a bracket 204 that is attached to refrigerator appliance 100, e.g., at refrigerator door 128. In some such embodiments, refrigerator door 128 is provided as a door-in-door configuration. In other words, refrigerator door 128 may include a rotatable frame 182 that rotates to the open position of door (e.g., as illustrated in FIG. 2), as well as an external sub-door 184 that is pivotally attached to rotatable frame 182. During use, external sub-door 184 may thus be rotated into a sub-open position, as shown in FIGS. 3 and 4, permitting immediate access to storage bins 166 within fresh food chamber 122 while refrigerator door 128 remains in the closed position.

As illustrated, support base 202 is rotatably mounted to bracket 204 along a rotation axis A. A storage bin 206 may be selectively mated to support base 202. When assembled, support base 202 and storage may thus rotate in tandem between a home position (FIG. 3) and a distal position (FIG. 4). As shown, support base 202 and storage bin 206 pivots about rotation axis A, e.g., parallel to vertical direction V along a plane perpendicular thereto. In turn, the distal position support base 202 is angularly spaced apart from the home position. In some such embodiments, movement between the home position and the distal position may be restricted, at least in part, by the positioning of sub-door 184. For instance, support base 202 may abut sub-door 184 when sub-door 184 is in the sub-closed position (see FIGS. 1 and 2). By contrast, support base 202 may be permitted to rotate between the home position and the distal position when sub-door 184 is in the sub-open position (see FIGS. 3 and 4).

Turning now to FIGS. 5 through 8, storage assembly 200 is shown apart from refrigerator appliance 100 (FIG. 2). As illustrated, storage bin 206 may generally define a storage volume 208 in which items to be refrigerated may be held. For instance, one or more sidewalls 210 may extend from a base wall 212 to define a storage volume 208 that is generally open, e.g., in the vertical direction V. Moreover, storage bin 206 may define a recess 214 positioned at a corner of storage bin 206, e.g., to complement a bracket 204 and/or shroud 226. Although shown as a four-sided open storage bin 206, other embodiments may be formed as any other suitable bin shape.

Figure 5:
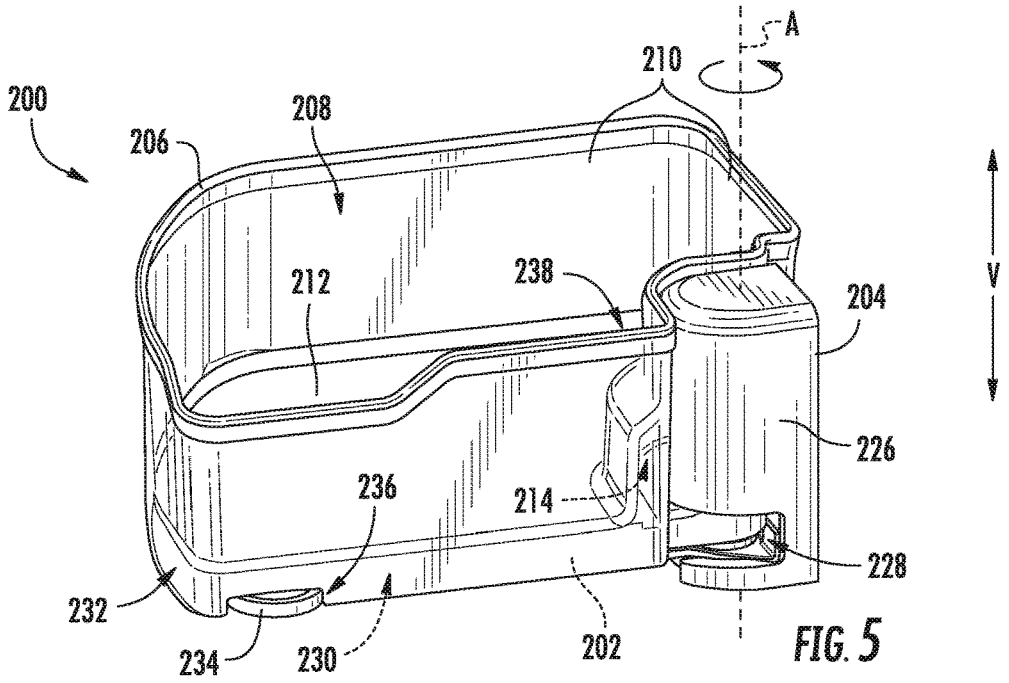
FIG. 5 provides a perspective view of a storage assembly according to example embodiments of the present disclosure.
Figure 6:
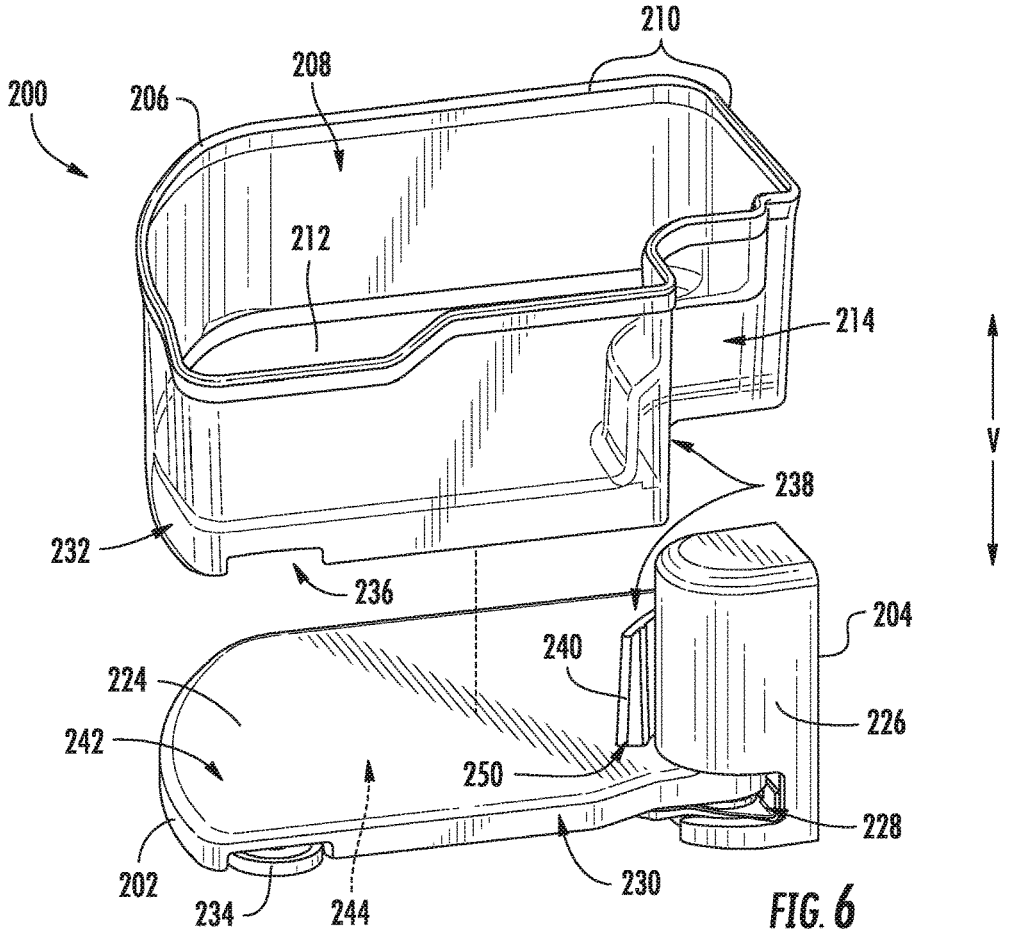
FIG. 6 provides a perspective view of the example storage assembly of FIG. 5, wherein a storage bin has been removed from the support base.
Figure 7:
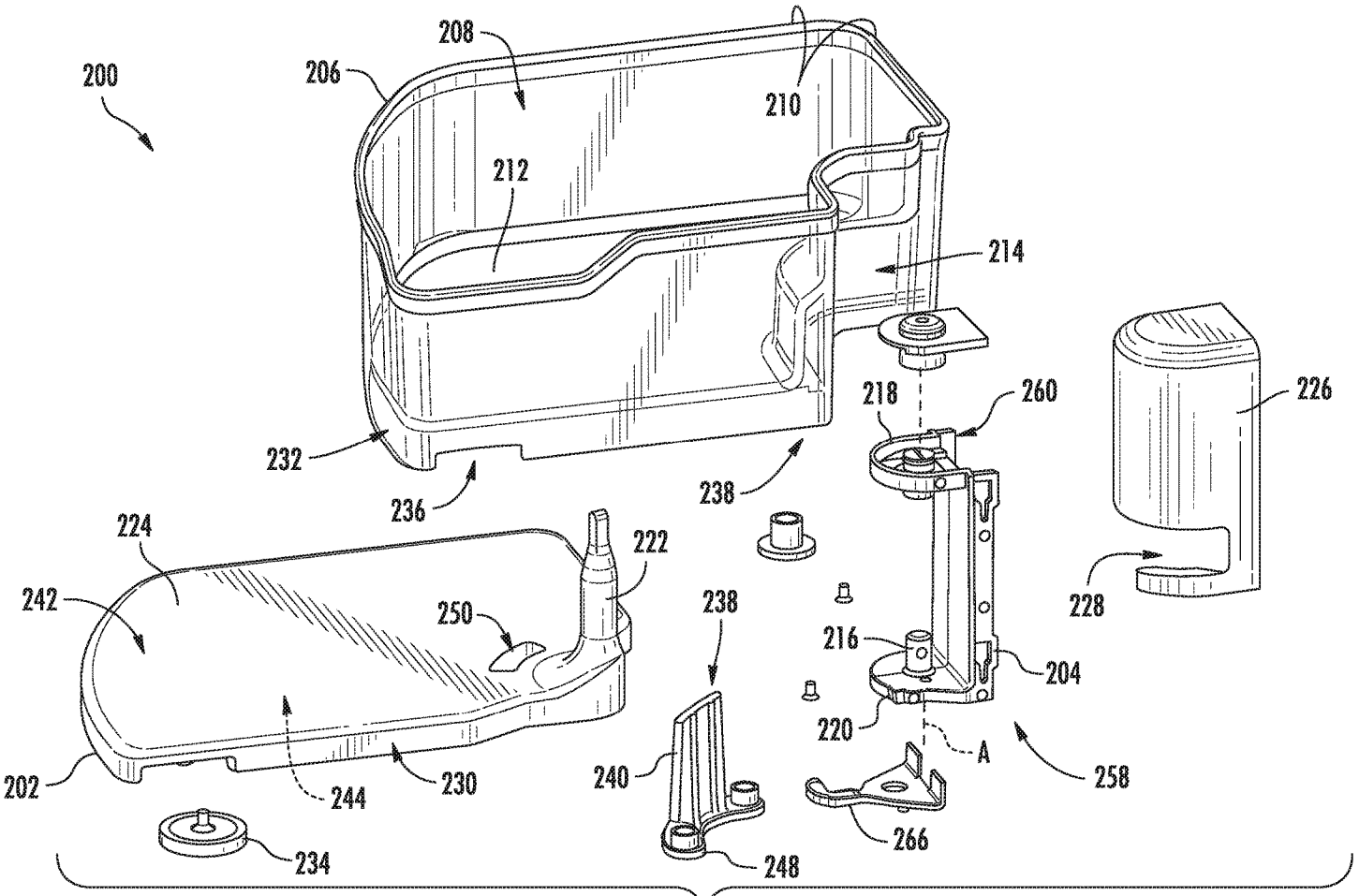
FIG. 7 provides an exploded perspective view of the example storage assembly of FIG. 5.
Figure 8:
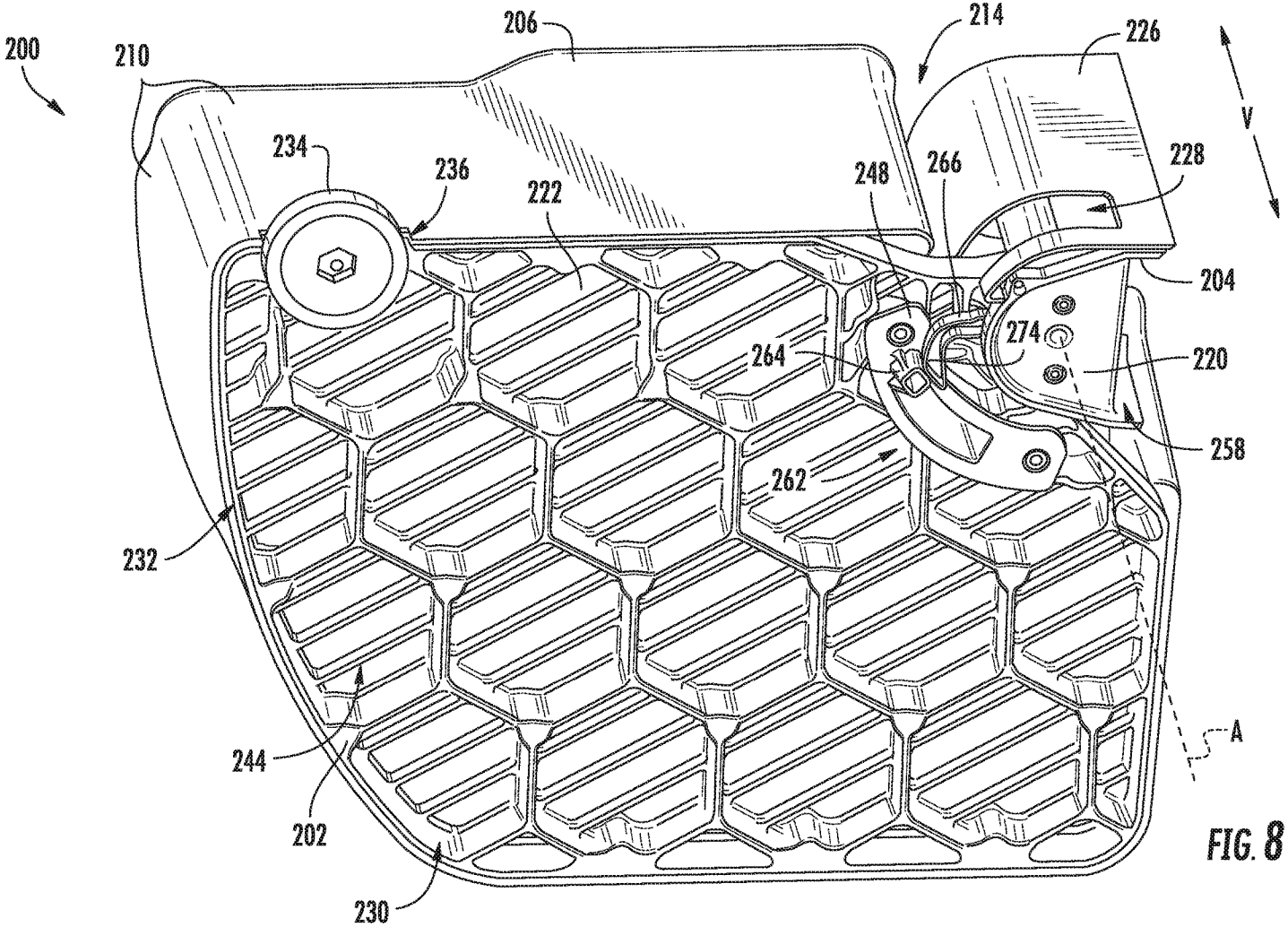
FIG. 8 provides a bottom perspective view of the example storage assembly of FIG. 5.

Generally, storage bin 206 is receivable on support base 202. Thus, storage bin 206 may rest on support base 202, as shown in FIG. 5. Storage bin 206 may also be removed from support base 202, as shown in FIG. 6 (e.g., to permit cleaning of storage bin 206). In alternative example embodiments, storage assembly 200 need not include separate storage bin 206 and support base 202, rather storage bin 206 and support base 202 may be integrally formed with a single continuous piece of material, such as molded plastic. When assembled, storage bin 206 is rotatably mounted to bracket 204 along rotation axis A.

In some embodiments, bracket 204 includes a pivot pin 216 that generally defines the rotation axis A. Pivot pin 216 may thus extend along the rotation axis A. For instance, bracket 204 may extend along the vertical direction V from an upper tab 218 to a lower tab 220. Pivot pin 216 may be formed on lower tab 220, e.g., extending therefrom. When assembled, support base 202 may receive at least a portion of pivot pin 216. Moreover, a complementary axis pin 222 may be formed on support base 202 above pivot pin 216, e.g., vertically from reinforcement plate 224. In turn, the assembled axis pin 222 may be coaxial with pivot pin 216. Moreover, axis pin 222 may further extend to upper tab 218, e.g., to restrict horizontal movement of support base 202. Optionally, a shroud 226 may be positioned over a portion of bracket 204. For instance, shroud 226 may cover the bracket 204 from the upper tab 218 to the lower tab 220, including pivot pin 216 and axis pin 222. A slotted opening 228 may further be defined by shroud 226 perpendicular to the rotation axis A. When assembled, reinforcement plate 224 may extend through slotted opening 228 to connect with axis pin 222.

As shown, reinforcement plate 224 of base bracket 204 includes a peripheral edge 230 that may generally define the footprint of base bracket 204, e.g., the footprint in a plane perpendicular to the rotation axis A. Storage bin 206 may be similarly shaped according to the same general footprint. For instance, storage bin 206 may be formed to follow peripheral edge 230, e.g., to the exclusion of the portion of reinforcement plate 224 beneath axis pin 222 and/or extending through slotted opening 228. In turn, storage bin 206 may include a complementary shape positioned above reinforcement plate 224 when assembled. In some embodiments, storage bin 206 includes a mating rim 232 extending downward below storage volume 208 at a bottom of storage bin 206. For instance, mating rim 232 may extend downward from base wall 212. When assembled, mating rim 232 may extend about or along at least a portion of the peripheral edge 230 of reinforcement plate 224. Mating rim 232 may assist with hiding support base 202 (as shown in FIG. 5) when storage bin 206 is disposed on support base 202 in order to improve a cosmetic appearance of storage assembly 200.

In some embodiments, a bumper 234 is included on storage assembly 200. For instance, bumper 234 may be mounted on support base 202. At least a portion of bumper 234 may extend outward from the peripheral edge 230. Specifically, bumper 234 may extend from the peripheral edge 230 (e.g., outward beyond a horizontal extreme of support base 202) towards an inner surface of a refrigerator door (e.g., at an inner surface of external sub-door 184—FIGS. 3 and 4). Bumper 234 may be rotatably mounted on support base 202, e.g., as a resilient or elastic wheel. Moreover, in certain embodiments, bumper 234 further extends through an aperture 236 defined by mating rim 232 When assembled, bumper 234 may selectively contact the inner surface of external sub-door 184 as one or both of external sub-door 184 and support base 202 are rotated. As refrigerator door 128 (FIG. 2) and/or external sub-door 183 rotated to the closed position, an inner surface of external sub-door 184 may thus contact bumper 234, which in turn, rotates along the inner surface of external sub-door 184 as support base 202 is pushed towards the home position. Advantageously, bumper 234 may prevent any portion of support base 202 and/or storage bin 206 from marring or marking the corresponding refrigerator door 128.

Figure 9:
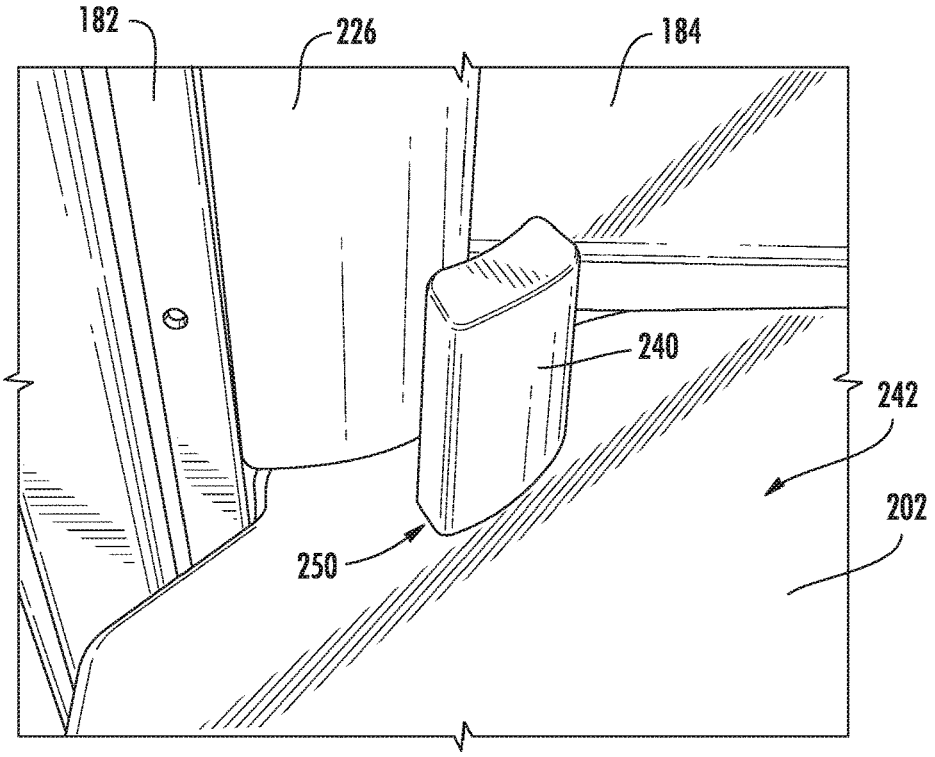
FIG. 9 provides a magnified top perspective view of a portion of the support base of the example storage assembly of FIG. 5.
Figure 10:
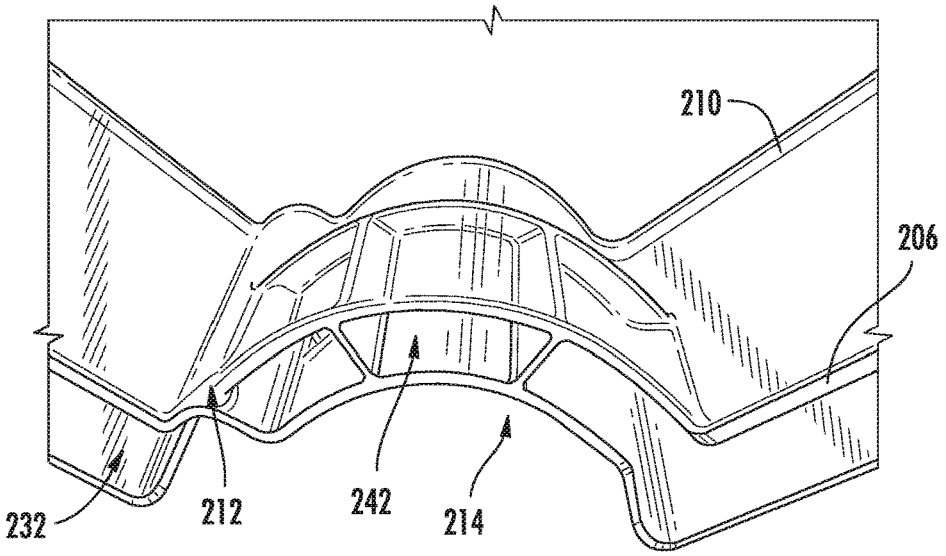
FIG. 10 provides a magnified bottom perspective view of a portion of the storage bin of the example storage assembly of FIG. 5.

Returning to FIGS. 5 through 8, as well as FIGS. 9 and 10, certain embodiments include storage bin 206 removably mated to support base 202. For instance, storage bin 206 may be selectively positioned above a reinforcement plate 224 of support base 202. When mated together, e.g., as illustrated in FIG. 5, storage bin 206 may thus rest on support base 202. In order to remove storage bin 206 from support base 202, storage bin 206 may be lifted directly from support base 202 (e.g., vertically and/or parallel to rotation axis A), e.g., as illustrated in FIG. 6.

In some embodiments, a mating pair 238 is formed between the support base 202 and the storage bin 206. When assembled, the mating pair 238 may thus join support base 202 and storage bin 206, further assisting in alignment between the mounted storage bin 206. As shown, mating pair 238 may include a complementary post 240 and pocket 242. Generally, one of post 240 and pocket 242 is included on support base 202, while the other of post 240 and pocket 242 is included on storage bin 206. For instance, as illustrated, post 240 may extend along the vertical direction V from support base 202 where it may be received in pocket 242 defined on storage bin 206, e.g., adjacent the defined recess 214 within storage volume 208. In some such embodiments, post 240 is included as a discrete member that may be mounted to support base 202. Optionally, a portion of post 240 may be attached to a bottom surface 244 of support base 202 and extend through a slot 250 defined from the bottom surface 244 to a top surface 246 of support base 202. In the example embodiments of FIGS. 5 through 10, post 240 includes an attachment flange 248 fixed to the bottom surface 244 of support base 202. When assembled, slot 250 (and thereby post 240) may be vertically aligned with pocket 242 to simultaneously receive at least a portion of post 240. Specifically, slot 250 may be aligned along the vertical direction V such that each item generally overlaps within a two dimensional plane perpendicular to the vertical direction V.

Figure 11:
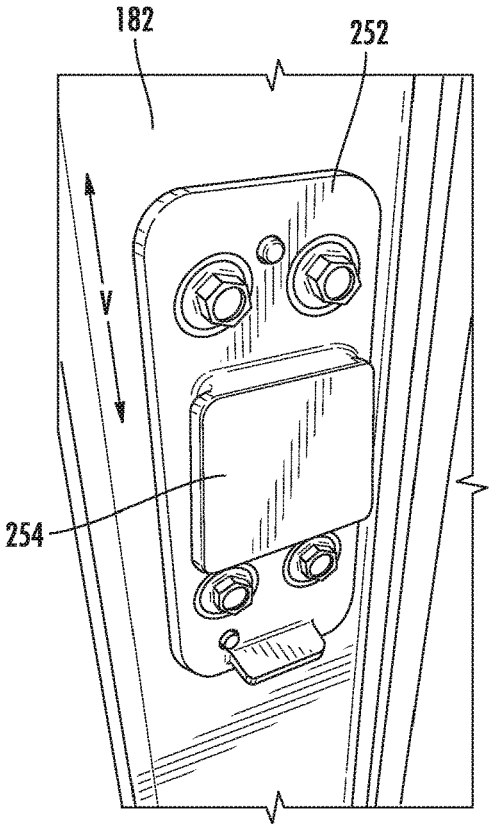
FIG. 11 provides a perspective view of a mounting plate on a refrigerator appliance according to example embodiments of the present disclosure.
Figure 12:
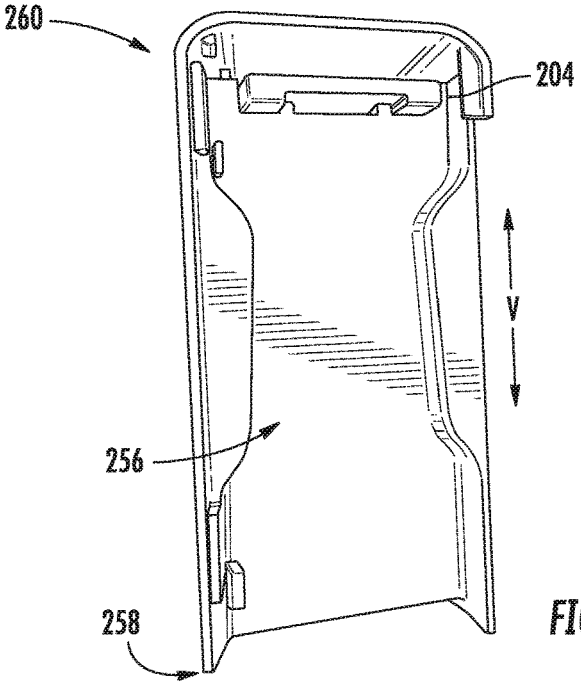
FIG. 12 provides a perspective view of a bracket attachable to example mounting plate of FIG. 11.

Turning now to FIGS. 11 and 12, storage assembly 200 may be removably attached to refrigerator appliance 100, e.g., to permit storage assembly 200 to selectively attach or detach from refrigerator appliance 100 (FIG. 2). For instance, storage assembly 200 may include a mounting plate 252 selectively mated to bracket 204. Mounting plate 252 may be fixed (e.g., via one or more adhesives or suitable mechanical connectors, such as a mounting bolt, etc.) to refrigerator appliance 100. In the illustrated embodiment of FIG. 11, mounted plate is fixed to an interior portion of refrigerator door 128, e.g., at rotatable frame 182. In some such embodiments, storage assembly 200 includes a mating tongue 254 extending outward (e.g., perpendicular to the vertical direction V) from refrigerator appliance 100, e.g., at a corresponding refrigerator door 128. A complementary groove 256 may be defined on bracket 204, as shown in FIG. 12. The groove 256 may be generally open along a bottom portion 258 of bracket 204 and closed along a top portion 260 of bracket 204. In turn, the groove 256 may selectively receive the mating tongue 254 at the bottom portion 258 of bracket 204 to rest thereon. As shown, mating tongue 254 includes a dovetail shape (i.e., a narrow neck connecting a larger flared head to an attachment point or plate). However, other suitable shapes may be included and formed to match the complementary groove 256.

Certain embodiments of the present disclosure include a positioning assembly 262 as illustrated in FIGS. 13 through 16. Generally, positioning assembly 262 may hold or bias support base 202 toward a desired position (e.g., the home position or the distal position). In some such embodiments, positioning assembly 262 includes a selectively-engaged positioning prong 264 and elastic finger 266. As shown, positioning prong 264 extends downward along the vertical direction V from support base 202. In other words, prong 264 extends below support base 202 (e.g., directly beneath the bottom surface 244). Positioning prong 264 may be formed to include an angular (i.e., non-circular) cross-section in a plane perpendicular to the rotation axis A. In the illustrated embodiments, positioning prong 264 has a generally rectangular cross-section. However, other embodiments may be formed according to any other suitable shape.

Optionally, positioning prong 264 may be formed on attachment flange 248 and extend therefrom. When assembled, positioning prong 264 is rotationally fixed to support base 202 and/or storage bin 206. Thus, positioning prong 264 will rotate with support base 202 such that the angular position of the positioning prong 264 corresponds to the angular position of the support base 202 relative to the rotation axis A. Movements or restrictions to the positioning prong 264 will be imbued or translated to support base 202, and vice versa.

As shown, elastic finger 266 is positioned to selectively engage positioning prong 264. For instance, elastic finger 266 may selectively engage positioning prong 264 in a predefined rotational position, e.g., the home position. In some embodiments, elastic finger 266 is attached to bracket 204. In the example embodiments of FIGS. 13 through 15, elastic finger 266 is mounted to bracket 204 to extend therefrom. Specifically, elastic finger 266 is held between the lower tab 220 of bracket 204 and the bottom surface 244 of support base 202. Elastic finger 266 extends from bracket 204 perpendicular to the vertical direction V.

In certain embodiments, elastic finger 266 may be formed to include an angular (i.e., non-circular) cross-section in a plane perpendicular to the rotation axis A. In the illustrated embodiments, elastic finger 266 has a generally V-shaped cross-section. One segment 268 extends from bracket 204 before bending at an angle (e.g., between 30° and 110°) into another segment 270. However, other embodiments may be formed according to another suitable shape. For instance, turning briefly to FIG. 17, elastic finger 266 has a generally U-shaped cross-section. One segment 268 extends from bracket 204 before bending at an angle (e.g., between 30° and 110°) into another segment 270 before then bending at an angle (e.g., between 30° and 110°) at a third segment 272. In such embodiments, ridge 274 may be formed on the most distal segment (e.g., third segment 272).

Figure 13:
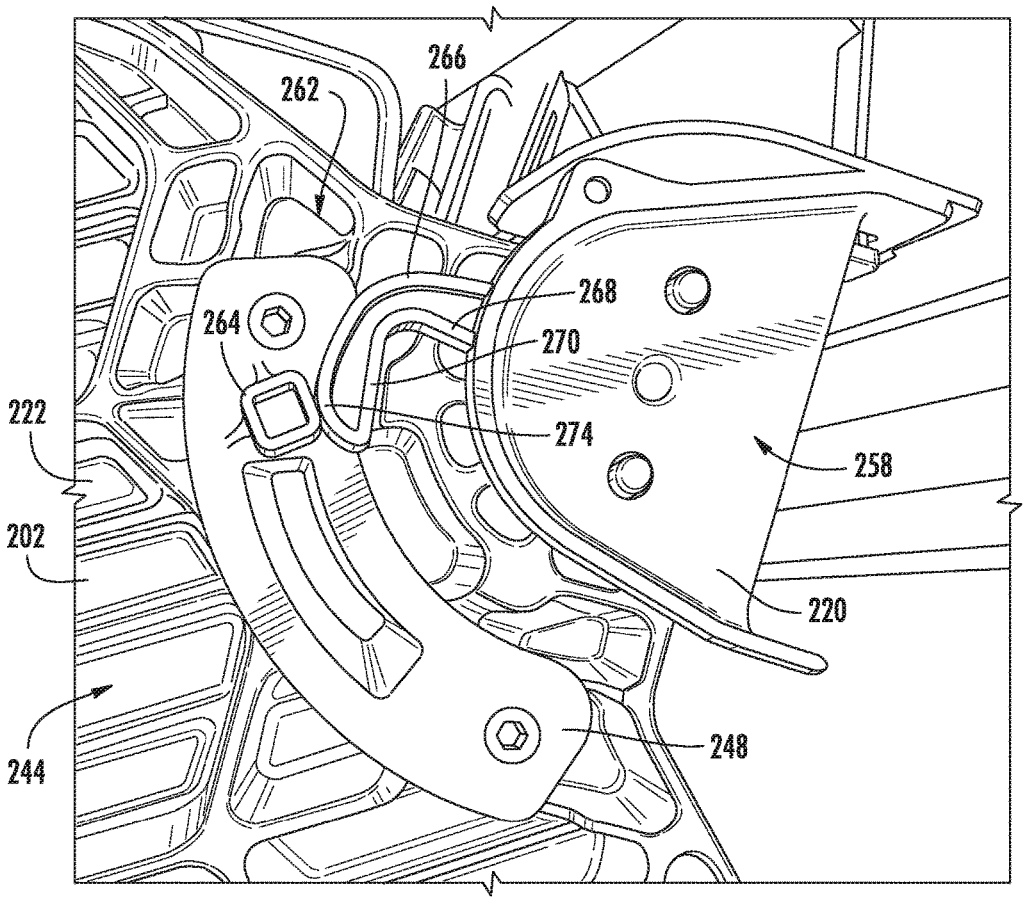
FIG. 13 provides a magnified bottom view of a positioning assembly of the example storage assembly of FIG. 5, wherein an elastic prong is in a first set position to hold the support base in the home position.
Figure 14:
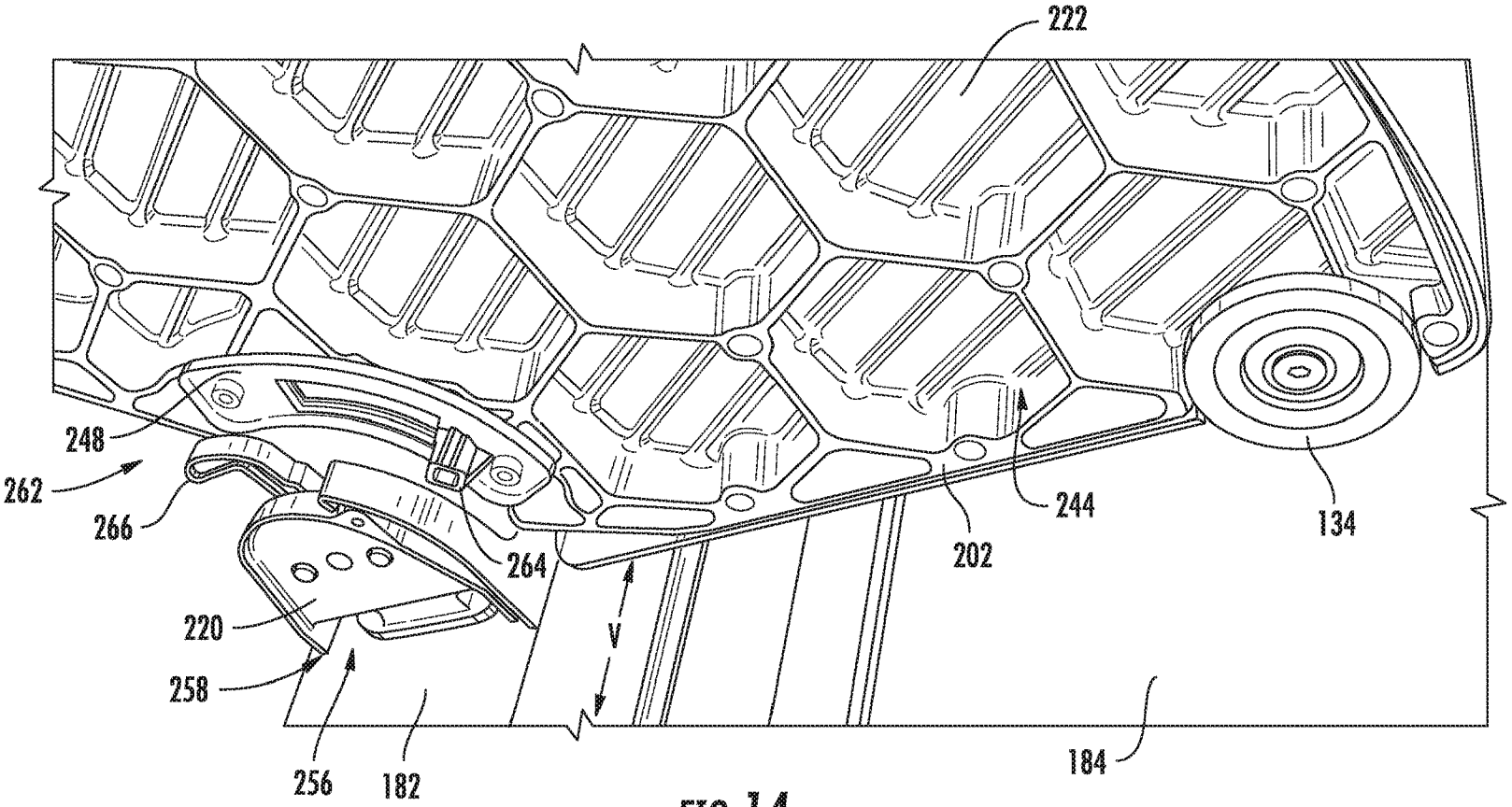
FIG. 14 provides a magnified bottom perspective view of the positioning assembly of FIG. 13, wherein the support base is shown at the home position.
Figure 15:
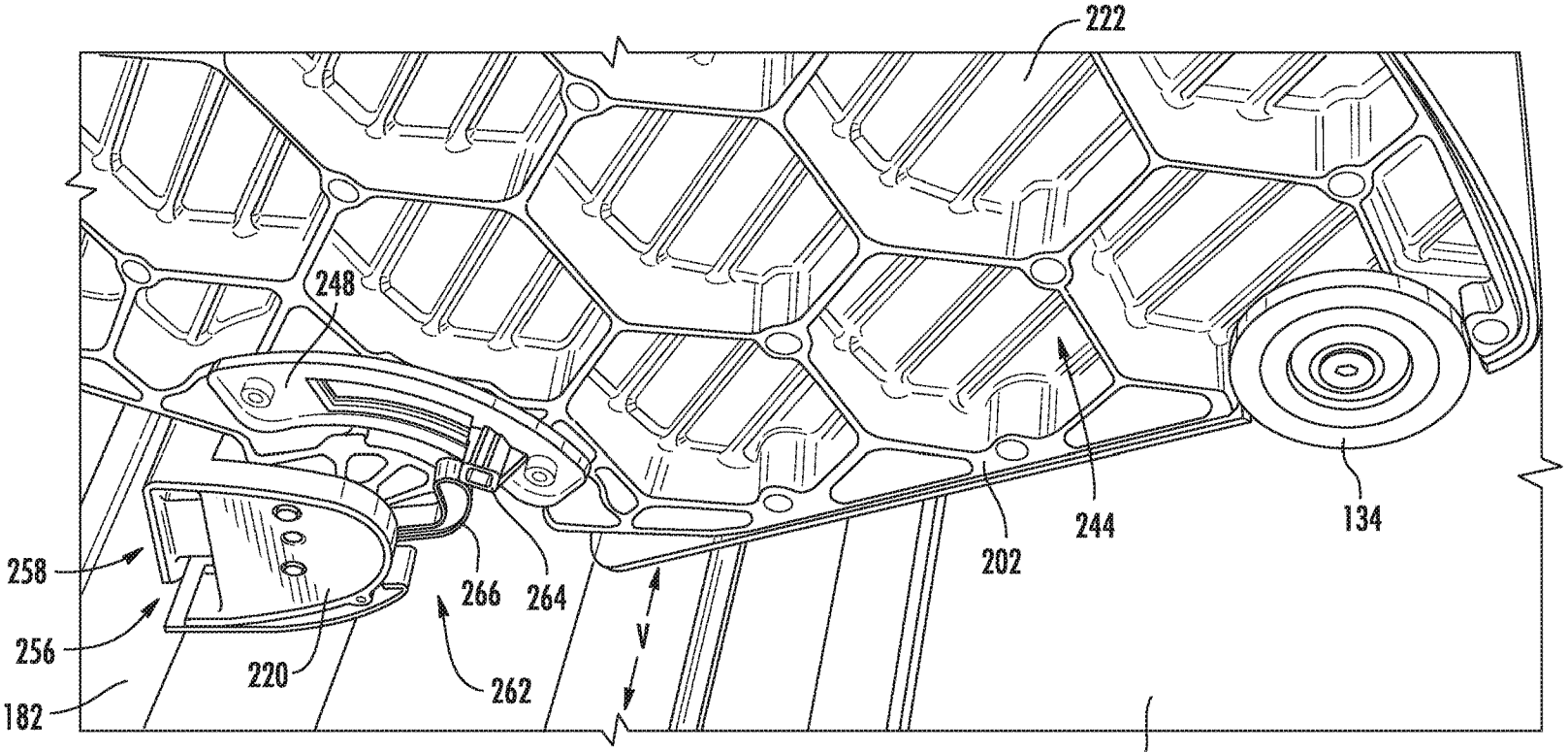
FIG. 15 provides a magnified bottom perspective view of the positioning assembly of FIG. 13, wherein the support base is shown at a distal position.

In some embodiments, elastic finger 266 may selectively hold support base 202 in the home position. As shown in FIGS. 13 through 15, elastic finger 266 may define a ridge 274. The ridge 274 may extend, for example, from the second segment 270 to contact positioning prong 264. In the home position, positioning prong 264 is held against the ridge 274 in an interference fit. Thus, support base 202 is held in the home position. In order to move support base 202 away from the home position, a user may motivate or rotate support plate, thereby deflecting elastic finger 266 inward (e.g., toward the rotation axis A) and overcoming the interference fit.

Figure 16:
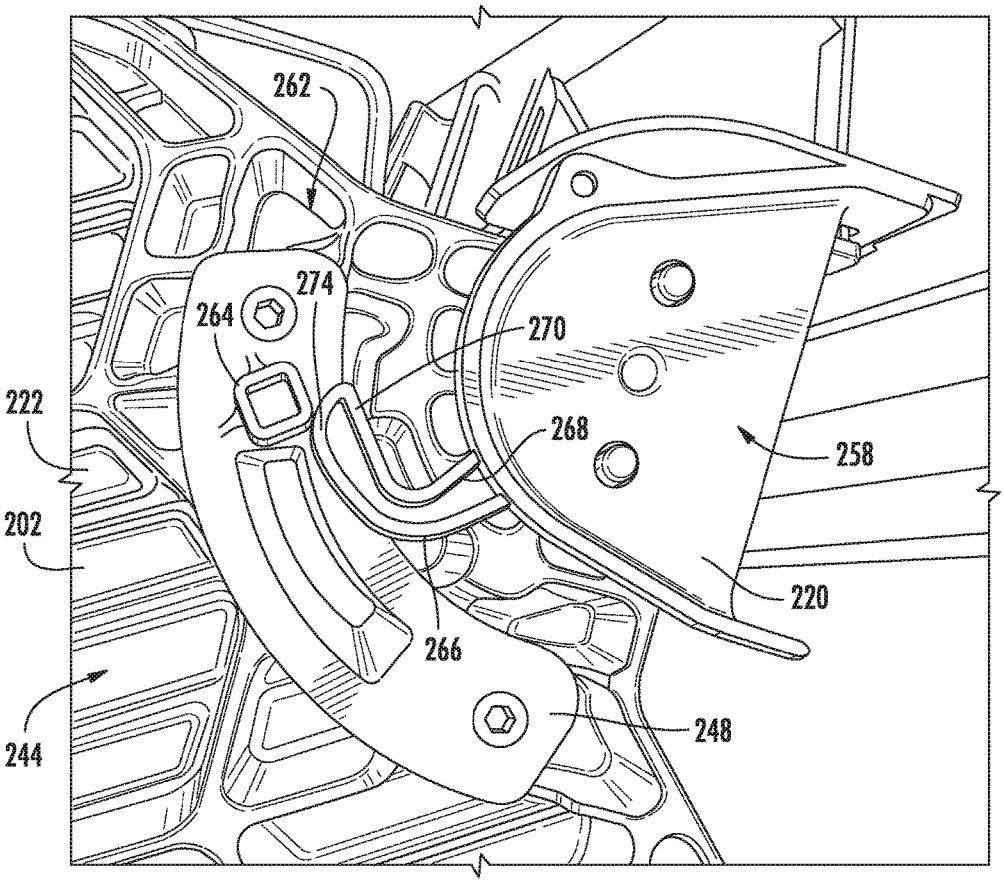
FIG. 16 provides a magnified bottom perspective view of the positioning assembly of FIG. 13, wherein an elastic prong is in a second set position to bias the support base away from the home position.
Figure 17:
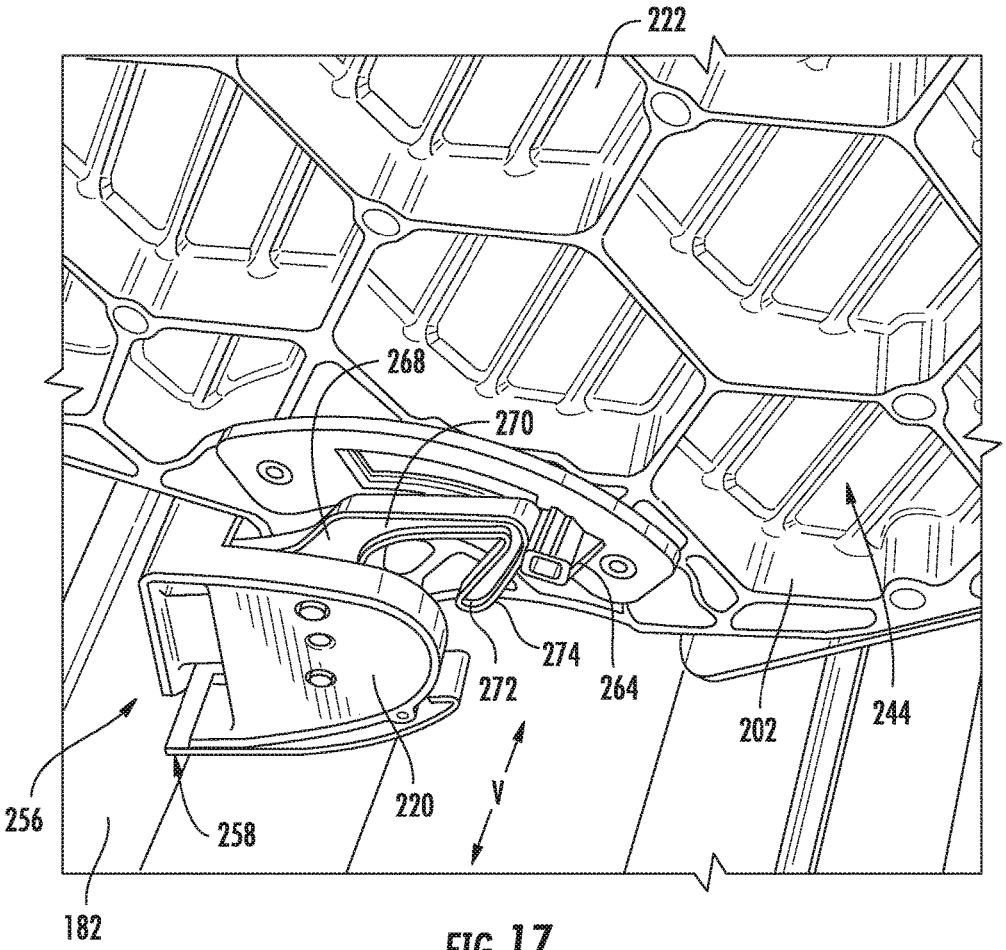
FIG. 17 provides a magnified bottom view of a positioning assembly of a storage assembly according to other example embodiments of the present disclosure.

In additional or alternative embodiments, elastic finger 266 may act to motivate support base 202 away from the home position. As shown in FIGS. 16 and 17, elastic finger 266 may define a ridge 274. The ridge 274 may extend, for example, from the second segment 270 to contact positioning prong 264, as shown in FIG. 16. Alternatively, the ridge 274 may extend from the third segment 272 to contact positioning prong 264, as shown in FIG. 17. In the home position, positioning prong 264 is held against the ridge 274 in a biased engagement. Elastic finger 266 is displaced or contracted as support plate and positioning prong 264 are placed in the home position by an external force, e.g., by the force of refrigerator door 128 acting against support plate. Once the external force is removed, elastic finger 266 may return to a steady, non-displaced state, moving positioning prong 264 in the process. Elastic finger 266 may thus motivate positioning prong 264 and/or support plate to rotate away from the home position toward the distal position. Support plate and storage bin 206 may thus be rotated out and "presented" to a user upon opening external sub-door 184.

In still further additional or alternative embodiments, elastic finger 266 is movable between at least two set positions. For instance, elastic finger 266 may be selectively mounted in a first position (FIGS. 13 through 15) or a second position (FIG. 16). The first position may direct elastic finger 266 in one rotational direction while the second position directs elastic finger 266 in an opposite rotational direction. In the first position, elastic finger 266 may selectively hold positioning prong 264 against the ridge 274 at the home position, as described above. In the second position, elastic finger 266 may selectively hold positioning prong 264 in biased engagement with the positioning prong 264 to motivate the support base 202 away from the home position, as further described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising a storage assembly for the refrigerator appliance defining a vertical direction, the storage assembly comprising:

a bracket attached to the refrigerator appliance;

a support base rotatably mounted to the bracket along a rotation axis;

a storage bin removably mated to the support base and positioned thereabove;

a mating pair formed between the support base and the storage bin, the mating pair comprising a post and pocket, the post extending along the vertical direction from one of the support base and the storage bin, and the pocket being defined within the other of the support base and the storage bin to receive the post therein;

a positioning prong extending downward along the vertical direction from the support base; and an elastic finger extending from the bracket to selectively engage the positioning prong in a predefined rotational position.

2. The refrigerator appliance of claim 1, wherein the support base defines a slot vertically aligned with the pocket, and wherein the post extends through the slot toward the pocket.

3. The refrigerator appliance of claim 1, wherein the support base is rotatable between a home position and a distal position angularly spaced apart from the home position, and wherein the elastic finger defines a ridge to selectively hold the support base in the home position.

4. The refrigerator appliance of claim 1, wherein the support base is rotatable between a home position and a distal position angularly spaced apart from the home position, and wherein the elastic finger is in biased engagement with the positioning prong to motivate the support base away from the home position.

5. The refrigerator appliance of claim 4, wherein the elastic finger defines a ridge and is movable between two set positions, the first position comprising the elastic finger selectively holding the positioning prong against the ridge, the second position comprising the elastic finger in biased engagement with the positioning prong to motivate the support base away from the home position.

6. The refrigerator appliance of claim 1, further comprising a bumper rotatably mounted to the support base and radially spaced from the rotation axis at a peripheral edge thereof.

7. The refrigerator appliance of claim 1, further comprising a mounting plate fixed to the refrigerator appliance, the mounting plate comprising a mating tongue, and wherein the bracket defines a groove to selectively receive the mating tongue.

8. The refrigerator appliance of claim 1, further comprising a shroud covering at least a portion of the bracket, the shroud defining a slotted opening, wherein a portion of the support base extends through the slotted opening to mount to the bracket.

9. The refrigerator appliance of claim 1, wherein the bracket is attached to a refrigerator door and selectively received within a chilled chamber of the refrigerator appliance.

10. A refrigerator appliance comprising a storage assembly for the refrigerator appliance defining a vertical direction, the storage assembly comprising:

a bracket attached to the refrigerator appliance;

a storage bin rotatably mounted to the bracket along a rotation axis between a home position and a distal position angularly spaced apart from the home position;

a positioning prong extending below the storage bin in the vertical direction, the positioning prong being rotationally fixed relative to the storage bin; and an elastic finger extending from the bracket perpendicular to the axis of rotation, the elastic finger defining a ridge to selectively hold the positioning prong in the home position.

11. The refrigerator appliance of claim 10, wherein the elastic finger is movable between two set positions, the first position comprising the elastic finger selectively holding the positioning prong against the ridge, the second position comprising the elastic finger in biased engagement with the positioning prong to motivate the support base away from the home position.

12. The refrigerator appliance of claim 10, further comprising a bumper rotatably mounted to a support base and radially spaced from the rotation axis at a peripheral edge thereof.

13. The refrigerator appliance of claim 10, further comprising a mounting plate fixed to the refrigerator appliance, the mounting plate comprising a mating tongue, and wherein the bracket defines a groove to selectively receive the mating tongue.

14. The refrigerator appliance of claim 10, further comprising a shroud covering at least a portion of the bracket, the shroud defining a slotted opening, wherein the storage bin is secured to the bracket through the slotted opening.

15. The refrigerator appliance of claim 10, wherein the bracket is attached to a refrigerator door and selectively received within a chilled chamber of the refrigerator appliance.

16. A refrigerator appliance comprising a storage assembly for the refrigerator appliance defining a vertical direction, the storage assembly comprising:

a bracket attached to the refrigerator appliance;

a storage bin rotatably mounted to the bracket along a rotation axis between a home position and a distal position angularly spaced apart from the home position;

a positioning prong extending below the storage bin in the vertical direction, the positioning prong being rotationally fixed relative to the storage bin; and an elastic finger extending from the bracket perpendicular to the axis of rotation, the elastic finger being in biased engagement with the positioning prong to motivate the storage bin away from the home position.

17. The refrigerator appliance of claim 16, further comprising a rotating bumper radially spaced from the rotation axis at a peripheral edge of a support base.

18. The refrigerator appliance of claim 16, further comprising a mounting plate fixed to the refrigerator appliance, the mounting plate comprising a mating tongue, and wherein the bracket defines a groove to selectively receive the mating tongue.

19. The refrigerator appliance of claim 16, wherein the bracket is attached to a refrigerator door and selectively received within a chilled chamber of the refrigerator appliance.

20. A refrigerator appliance comprising a storage assembly for the refrigerator appliance defining a vertical direction, the storage assembly comprising:

a bracket attached to the refrigerator appliance;

a support base rotatably mounted to the bracket along a rotation axis;

a storage bin removably mated to the support base and positioned thereabove; and a mating pair formed between the support base and the storage bin, the mating pair comprising a post and pocket, the post extending along the vertical direction from one of the support base and the storage bin, and the pocket being defined within the other of the support base and the storage bin to receive the post therein, wherein the bracket is attached to a refrigerator door and selectively received within a chilled chamber of the refrigerator appliance.

21. A refrigerator appliance comprising a storage assembly for the refrigerator appliance defining a vertical direction, the storage assembly comprising:

a bracket attached to the refrigerator appliance;

a support base rotatably mounted to the bracket along a rotation axis;

a storage bin removably mated to the support base and positioned thereabove;

a mating pair formed between the support base and the storage bin, the mating pair comprising a post and pocket, the post extending along the vertical direction from one of the support base and the storage bin, and the pocket being defined within the other of the support base and the storage bin to receive the post therein; and a mounting plate fixed to the refrigerator appliance, the mounting plate comprising a mating tongue, and wherein the bracket defines a groove to selectively receive the mating tongue.

22. A refrigerator appliance comprising a storage assembly for the refrigerator appliance defining a vertical direction, the storage assembly comprising:

a bracket attached to the refrigerator appliance;

a support base rotatably mounted to the bracket along a rotation axis;

a storage bin removably mated to the support base and positioned thereabove;

a mating pair formed between the support base and the storage bin, the mating pair comprising a post and pocket, the post extending along the vertical direction from one of the support base and the storage bin, and the pocket being defined within the other of the support base and the storage bin to receive the post therein; and a shroud covering at least a portion of the bracket, the shroud defining a slotted opening, wherein a portion of the support base extends through the slotted opening to mount to the bracket.

* * * * *